US011701527B2

(12) United States Patent
Barker et al.

(10) Patent No.: US 11,701,527 B2
(45) Date of Patent: Jul. 18, 2023

(54) ENCLOSED SYSTEM ENVIRONMENT PRESSURE REGULATOR

(71) Applicant: B/E Aerospace, Inc., Winston-Salem, NC (US)

(72) Inventors: John T. Barker, Overland Park, KS (US); Bryce Baker, Raymore, MO (US)

(73) Assignee: B/E Aerospace, Inc., Winston-Salem, NC (US)

( * ) Notice: Subject to any disclaimer, the term of this patent is extended or adjusted under 35 U.S.C. 154(b) by 509 days.

(21) Appl. No.: 17/008,438

(22) Filed: Aug. 31, 2020

(65) Prior Publication Data

US 2022/0062663 A1 Mar. 3, 2022

(51) Int. Cl.

| | |
|---|---|
| ***A62B 7/02*** | (2006.01) |
| ***A62B 9/02*** | (2006.01) |
| ***B63C 11/24*** | (2006.01) |

(52) U.S. Cl.

CPC ..... *A62B 7/02* (2013.01); *A62B 9/022* (2013.01); *B63C 11/24* (2013.01)

(58) Field of Classification Search

CPC .... A62B 7/00; A62B 7/02; A62B 7/04; A62B 9/00; A62B 9/02; A62B 9/022; A62B 13/00; A62B 31/00; B63C 11/24

See application file for complete search history.

(56) References Cited

U.S. PATENT DOCUMENTS

| | | | | |
|---|---|---|---|---|
| 3,675,649 A | | 7/1972 | Basham et al. | |
| 4,823,788 A | * | 4/1989 | Smith | A62B 7/04 128/205.24 |
| 5,299,568 A | * | 4/1994 | Forare | A61M 16/202 128/205.24 |

(Continued)

FOREIGN PATENT DOCUMENTS

| | | |
|---|---|---|
| EP | 0518538 A3 | 4/1993 |
| EP | 3446756 A1 | 2/2019 |

(Continued)

OTHER PUBLICATIONS

Extended Search Report in European Application No. 21193122.5 dated Jan. 28, 2022, 8 pages.

*Primary Examiner* — Kathryn E Ditmer
(74) *Attorney, Agent, or Firm* — Suiter Swantz pc llo

(57) ABSTRACT

A pulse modulated oxygen dispensing and pressurization system provides a variable range of controlled oxygen bolus to an enclosed breathing environment supporting and maintaining required pressure conditions in accordance with desired flow demand. As oxygen is consumed by the user from within the enclosed breathing environment, the exhaled gases and moisture are conditioned or vented to acceptable levels by additional systems associated with the environment. These additional systems cause an ongoing need to replenish the oxygen within the environment and maintain the required partial pressure of oxygen. Specific to one of a plurality of modes of operation, the system responds (Continued)

to changes in regulated output pressure by delivering a precisely metered periodic bolus volume of oxygen to support a requirement of the environment volume. The bolus is variable based on a plurality of factors to increase and decrease changes in rates of flow required to maintain regulated pressure.

15 Claims, 9 Drawing Sheets

(56) References Cited

U.S. PATENT DOCUMENTS

| | | | | |
|---|---|---|---|---|
| 5,314,402 | A | 5/1994 | Foote et al. | |
| 5,755,224 | A * | 5/1998 | Good | A62B 9/02 128/205.24 |
| 6,789,539 | B2 | 9/2004 | Martinez | |
| 7,694,674 | B2 * | 4/2010 | Crome | C01B 13/0255 128/205.27 |
| 7,854,753 | B2 | 12/2010 | Kraft et al. | |
| 9,155,919 | B2 | 10/2015 | Huh | |
| 9,849,313 | B2 | 12/2017 | Aubonnet et al. | |
| 2007/0107729 | A1 * | 5/2007 | Aubonnet | A61M 16/0677 128/204.24 |
| 2009/0301489 | A1 | 12/2009 | Bloch et al. | |
| 2010/0078024 | A1 | 4/2010 | Andrieux et al. | |
| 2012/0055475 | A1 * | 3/2012 | Wilkinson | A61M 16/12 128/205.12 |
| 2013/0081627 | A1 * | 4/2013 | Bailey | A62B 7/14 128/204.26 |
| 2013/0247286 | A1 | 9/2013 | VanDerWoude et al. | |
| 2013/0247913 | A1 | 9/2013 | Aubonnet et al. | |
| 2013/0312743 | A1 * | 11/2013 | Kshirsagar | A62B 7/14 128/204.23 |
| 2014/0345609 | A1 * | 11/2014 | Whitcher | C01B 13/0259 128/202.26 |
| 2016/0193438 | A1 | 7/2016 | White et al. | |
| 2017/0100610 | A1 * | 4/2017 | Gurr | A62B 9/006 |
| 2019/0126076 | A1 | 5/2019 | McLaughlin et al. | |
| 2019/0224505 | A1 | 7/2019 | Walker et al. | |
| 2020/0001956 | A1 * | 1/2020 | Gauthier | B63C 11/24 |
| 2020/0215358 | A1 * | 7/2020 | Degenhardt | A62B 7/04 |
| 2021/0299483 | A1 * | 9/2021 | Feroy | A62B 7/02 |

FOREIGN PATENT DOCUMENTS

| | | | |
|---|---|---|---|
| KR | 101887163 | B1 * | 9/2018 |
| WO | 2019119054 | A1 | 6/2019 |

* cited by examiner

400

500

ENCLOSED SYSTEM ENVIRONMENT PRESSURE REGULATOR

BACKGROUND

Pressure regulators may traditionally provide adequate function. However, traditional regulators may be mechanically limited and unable able to provide timely function to a plurality of variable volumes and pressures.

As pressure suit design may evolve, traditional mechanical regulators may be less desirable due to their heavy weight and individual specification to match an individual application. Changing compartment sizes, variable suit and user sizes coupled with variable user fitness and oxygen consumption may require a cumbersome replacement of traditional regulators increasing cost and lead time for a unique solution to accommodate the individual and operating requirements.

Additional types of valves may function to pressurize a mobile volume but may require undesirable power consumption and maintain an undesirable weight for some desired mobile applications.

Therefore, a need remains for a gaseous pressure regulator system and related method which may overcome these limitations and provide a novel solution to efficiently adapt to a plurality of pressure environment volume, ambient conditions, and pressurization requirements without requiring a cumbersome mechanical replacement.

SUMMARY

One embodiment of the inventive concepts disclosed herein may include an enclosed system breathing environment pressure regulator. The system may comprise a pressure manifold coupled with a pressurized oxygen or breathing mixture (e.g., breathing gas) cylinder assembly and an enclosed breathing environment. Here, the pressure manifold may include a solenoid valve configured to produce a variable bolus of oxygen or breathing mixture when powered to an open position, a manifold pressure and temperature sensor sited between the solenoid valve and the pressurized oxygen or breathing mixture cylinder assembly regulator.

The pressure manifold may further include a flow pressure sensor sited between the solenoid valve seat and a precision orifice leading to the enclosed breathing environment, the flow pressure sensor configured to measure 1) a bolus pressure of the variable bolus of oxygen or breathing mixture and 2) a function of the solenoid valve. The system may include a regulated output sensor sited between the solenoid valve and the enclosed breathing environment, the regulated output sensor configured to measure a regulated output pressure and a regulated output temperature. Downstream of the regulated output sensor, the system may include a pressure attenuating plenum sited prior to the enclosed breathing environment to normalize the variable bolus of oxygen prior to entering the enclosed breathing environment.

The pressure manifold may be configured to receive a flow of pressure regulated oxygen or breathing mixture from the pressurized cylinder assembly and supply the solenoid valve with the flow of pressure regulated oxygen or breathing mixture, the pressure manifold further configured to route the variable bolus of oxygen to the enclosed breathing environment.

For control, the system may include a microcontroller associated with the pressure manifold and operatively coupled with 1) an oxygen or breathing mixture cylinder pressure sensor associated with the pressurized cylinder assembly, 2) the manifold sensor, 4) the solenoid valve, 4) the flow pressure sensor, and 5) the regulated output pressure sensor. For execution, the system may include a tangible, non-transitory memory configured to communicate with the microcontroller, the tangible, non-transitory memory having instructions stored therein that, in response to execution by the microcontroller, cause the microcontroller to carry out each function of the pressure regulator.

In operation, the microcontroller may monitor the bolus pressure via the flow pressure sensor, monitor a manifold data via the manifold sensor, the manifold data including a manifold pressure and a manifold temperature, and monitor a regulated output data via the regulated output pressure sensor, the regulated output data including the regulated output pressure and the regulated output temperature.

To begin the flow of gas, the microcontroller may send an initiation command to the pressurized cylinder assembly to initiate the flow of pressure regulated oxygen and determine an adjusted pulse width (APW) and a pulse interval based on the manifold data as well as a temperature compensated regulated output pressure.

To support pressure within the enclosed breathing environment, the microcontroller may apply a timed power pulse to command the solenoid valve to the open position for a duration of the APW at the pulse interval to produce the variable bolus of oxygen and verify the open position of the solenoid valve based on the bolus pressure. The microcontroller may continuously adjust the APW based on the temperature compensated regulated output pressure and the manifold data and apply the timed power pulse to command the solenoid valve to the open position for a duration of the APW at the pulse interval to produce the variable bolus of oxygen.

An additional embodiment of the inventive concepts disclosed herein may include a method for regulating pressure within an enclosed system breathing environment. The method may comprise sending an initiation command to an cylinder assembly to initiate a flow of pressure regulated oxygen and monitoring a manifold data from a manifold sensor associated with a pressure manifold which receives the flow of pressure regulated oxygen from the cylinder assembly, the manifold data including a manifold pressure and a manifold temperature.

To monitor output, the method may include monitoring a bolus pressure via a flow pressure sensor and monitoring a regulated output data via a regulated output sensor sited between the pressure attenuating plenum and an enclosed breathing environment, the regulated output sensor configured to measure a regulated output pressure and a regulated output temperature.

To support pressure within the enclosed breathing environment the method may include determining an adjusted pulse width (APW) and a pulse interval based on the regulated output data and the manifold data and applying a timed power pulse to a solenoid valve to an open position for a duration of the APW at the pulse interval to produce a variable bolus of oxygen supplied to the enclosed breathing environment. The method may further include verifying the open position of the solenoid valve based on the bolus pressure.

For control, the method may include continuously adjusting the APW based on each of: the regulated output data and the manifold data, and applying the timed power pulse to the solenoid valve to the open position for a duration of the APW at the pulse interval to produce the variable bolus of oxygen supplied to the enclosed breathing environment.

It is to be understood that both the foregoing general description and the following detailed description are exemplary and explanatory only and are not necessarily restrictive of the inventive concepts as claimed. The accompanying drawings, which are incorporated in and constitute a part of the specification, illustrate embodiments of the inventive concepts and together with the general description, serve to explain the principles of the inventive concepts disclosed herein.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings in which.

DETAILED DESCRIPTION OF EXEMPLARY EMBODIMENTS

Figure 1:
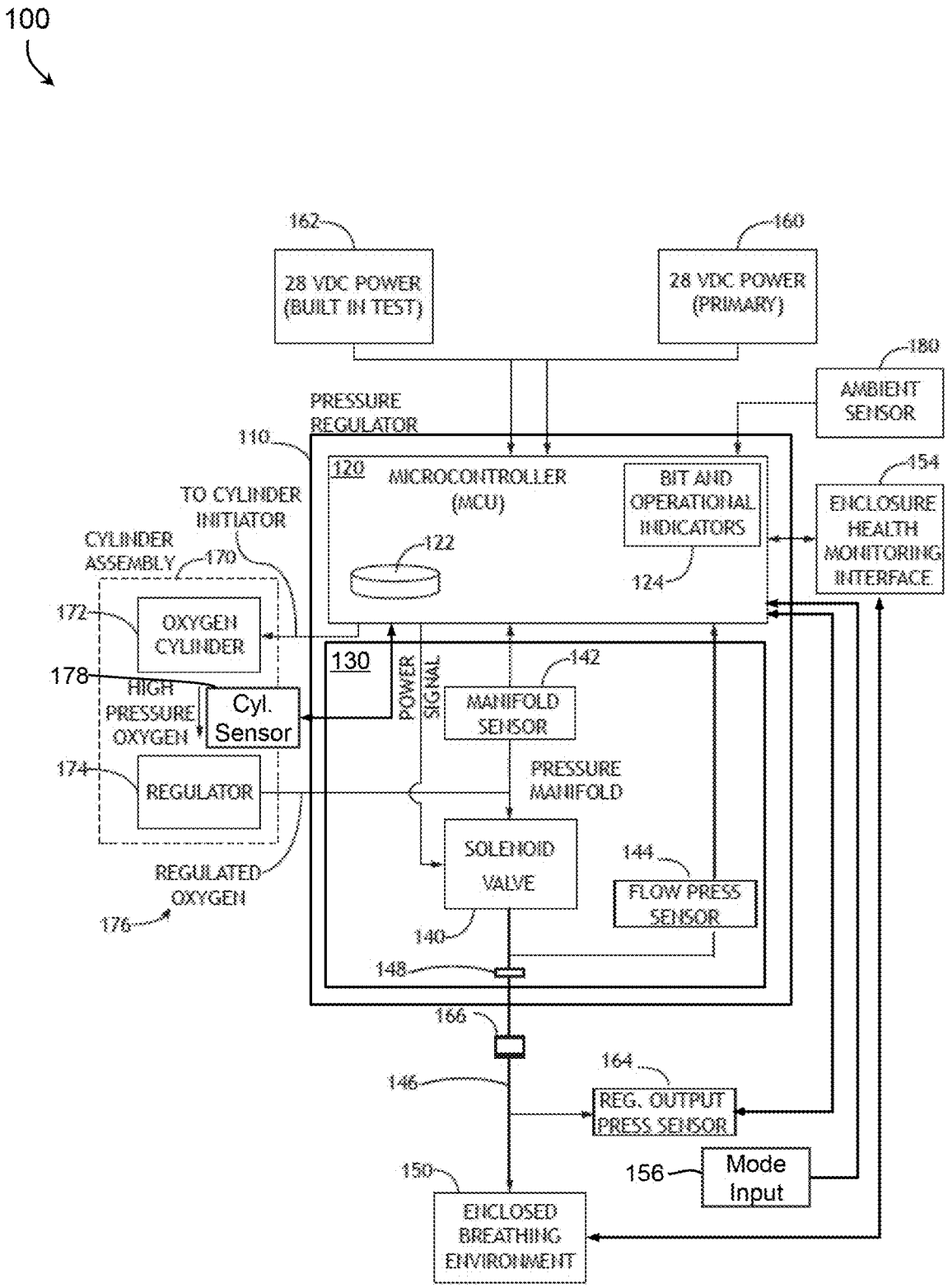
FIG. 1 is a block diagram of an enclosed system breathing environment pressure regulator in accordance with an embodiment of the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, thus "a" and "an" are intended to include one or at least one and the singular also includes the plural unless it is obvious that it is meant otherwise.

Further, the term "approximately" as used herein may be applied to a twenty percent range plus or minus from the given value. For example, approximately 100 may be interpreted and claimed as appropriate, as a range from 80 to 120.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Overview

Broadly, embodiments of the inventive concepts disclosed herein are directed to a pulse modulated oxygen or breathing mixture dispensing and pressurization system. The system may provide a variable range of controlled oxygen or breathing mixture bolus to an enclosed breathing environment supporting and maintaining required pressure conditions within the enclosed breathing environment in accordance with desired flow demand. As oxygen or breathing mixture is consumed by a user from within the enclosed breathing environment, the exhaled gases and moisture are conditioned or vented to acceptable levels by additional systems associated with the environment. These additional systems and leakage from the enclosed environment cause an ongoing need to replenish the oxygen or breathing mixture within the environment and maintain the required partial pressure of oxygen. Specific to a plurality of modes of operation, the system may respond to changes in regulated output pressure by delivering a precisely metered bolus volume of oxygen or breathing mixture to the environment volume limited by a precision fixed orifice. The bolus may be variable based on a plurality of factors including user metabolic rate, leakage and suit or enclosure volume to increase and decrease changes in rates of flow required to maintain regulated pressure.

REFERENCE CHART

| | | | |
|---|---|---|---|
| 100 | Oxygen System Block Diagram | 362 | BIT Indicator |
| 110 | Pressure Regulator | 364 | Flow Indicator |
| 120 | Microcontroller | 380 | Ambient Connector |
| 122 | Memory | 400 | Manifold Assembly |
| 124 | BIT and Operational Indicators | 500 | Oxygen Controller Functional Diagram |
| 130 | Pressure Manifold | 530 | Built-In-Test and Reporting |
| 140 | Solenoid Valve | 540 | Solenoid Valve Driver & Sense |
| 142 | Manifold Sensor | 550 | Suit Interface |
| 144 | Flow Pressure Sensor | 560 | Input Power Conditioning |
| 146 | Variable Bolus of Oxygen | 572 | Initiator Driver and Sense |
| 148 | Precision Fixed Orifice | 600 | Solenoid Valve |
| 150 | Enclosed Breathing Environment | 630 | Manifold Plenum |
| 152 | Enclosure Sensor | 640 | Poppet |
| 154 | Enclosure Health Monitor | 641 | Poppet Valve Seat |
| 156 | Mode Input | 642 | Solenoid Terminal |
| 160 | DC Power | 644 | Flow Pressure Sensing Port |
| 162 | BIT DC Power | 700 | Method and Information Flow |
| 164 | Regulated Output Sensor | | |
| 166 | Pressure Attenuating Plenum | | |
| 170 | Cylinder Assembly | | |
| 172 | Oxygen Cylinder | | |
| 174 | Source Regulator | | |
| 176 | Regulated Oxygen Flow | | |
| 178 | Cylinder Sensor | | |
| 180 | Ambient Sensor | | |
| 200 | Oxygen Controller Block Diagram | | |
| 242 | Solenoid Valve 1 | | |
| 244 | Solenoid Valve 2 | | |
| 246 | Solenoid Valve 3 | | |
| 248 | Solenoid Valve 4 | | |
| 272 | Initiator Signal | | |
| 300 | Oxygen Controller Assembly | | |
| 312 | Power Connector | | |
| 314 | Cylinder Initiator Connector | | |
| 316 | Programming Port and CAN interface | | |
| 342 | Solenoid 1 | | |
| 344 | Solenoid 2 | | |
| 346 | Solenoid 3 | | |
| 348 | Solenoid 4 | | |

FIGS. 1 & 2

Figure 2:
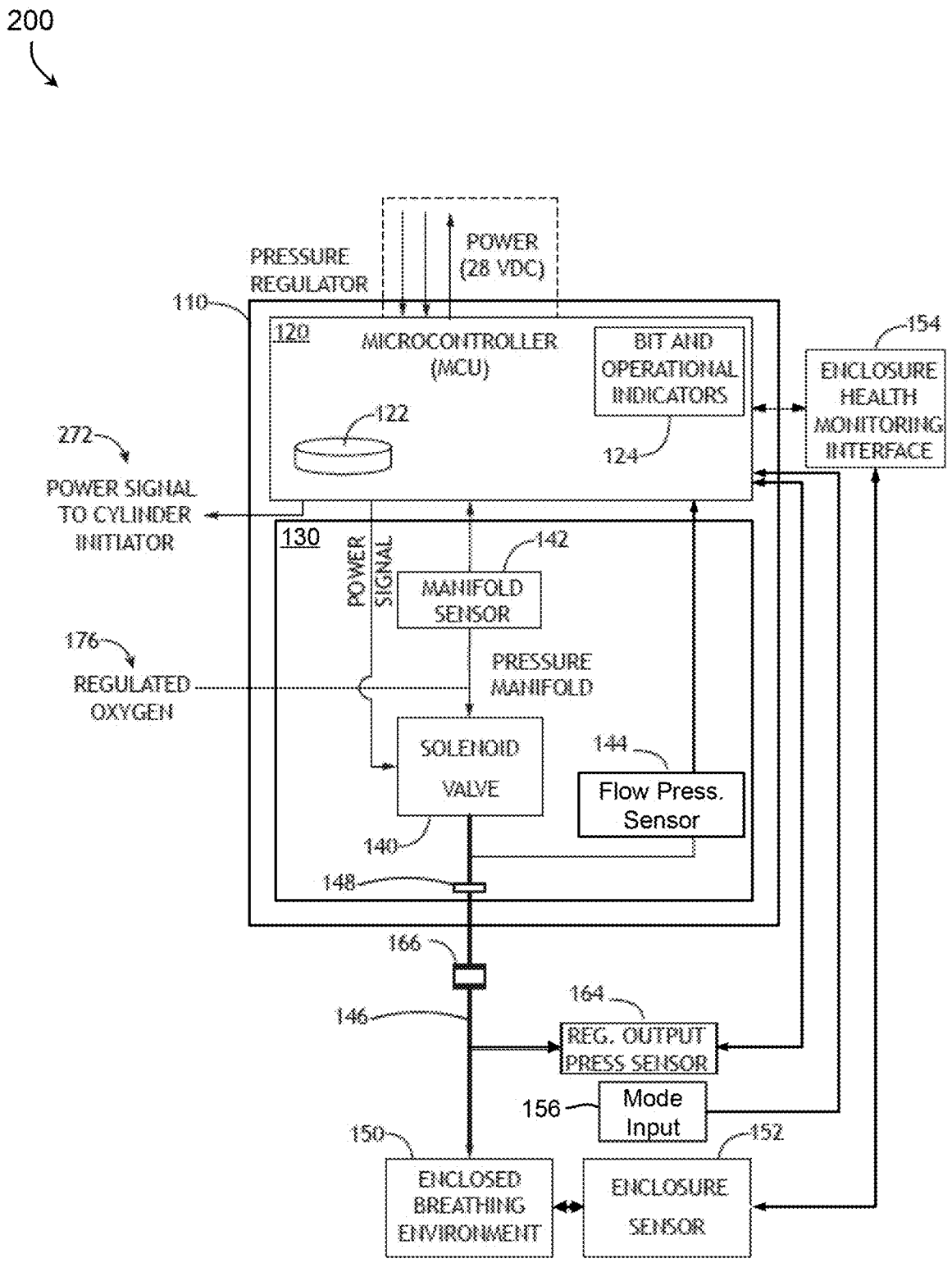
FIG. 2 is a detail block diagram of an enclosed system breathing environment pressure regulator in accordance with an embodiment of the inventive concepts disclosed herein.

Referring generally to FIG. 1 and FIG. 2, block diagrams of an enclosed system breathing environment pressure regulator in accordance with an embodiment of the inventive concepts disclosed herein is shown. A system block diagram 100 may indicate a high-level system view of an enclosed system breathing environment pressure regulator 110 (hereinafter "pressure regulator"). Generally, the pressure regulator 110 may function to provide a pressurization and a breathing gas to an enclosed breathing environment 150 from a pressurized cylinder assembly 170. The pressure regulator 110 may function to maintain a defined pressure constraint within the enclosed breathing environment 150 using pulse modulation to provide a flow to meet operational requirements of the enclosed breathing environment 150.

As used herein, the term "oxygen" may be used as a general term describing a gas usable for breathing by a person. In some applications, additional gas types may be added to an oxygen source (e.g., nitrogen, helium) to enable additional function of the breathable gas.

System Description

The pressure regulator 110 may include a pressure manifold 130 coupled via flexible or rigid pressure tubing with the pressurized cylinder assembly 170 and the enclosed breathing environment 150. The pressurized cylinder assembly 170 may include an oxygen cylinder 172 coupled with a source regulator 174 which may function to regulate an output of the oxygen cylinder 172 to a flow of pressure regulated oxygen 176. A cylinder sensor 178 may function to sense pressure and temperature associated with the oxygen in the cylinder 172. In one embodiment of the inventive concepts disclosed herein, the regulated oxygen flow may flow at approximately 16 to 30 pounds per square inch gauge (psig).

In one embodiment of the inventive concepts disclosed herein, the pressure manifold 130 may provide the regulated oxygen flow 176 to one or more solenoid valves 140 which, when open, supply the enclosed breathing environment 150 with regulated oxygen. Each solenoid valve 140 may be configured to produce a variable bolus of oxygen 146 when powered to an open position.

In one embodiment of the inventive concepts disclosed herein, the pressure manifold 130 may further comprise four solenoid valves 140. In one implementation, three of the four solenoid valves may be operational valves providing periodic pressure via the variable bolus of oxygen 146 to support the desired internal pressure of the enclosed breathing environment 150. The fourth solenoid valve 140 may open as a pressure relief function when a level of pressure in the manifold 130 may exceed for a period of time a predefined level of pressure as sensed by the manifold sensor 142. Upon the manifold pressure in the manifold 130 being restored, the fourth valve 140 may close. The total flow from all valves will not exceed a level as to cause damage or pose a risk to the suit or enclosure integrity.

In one embodiment of the inventive concepts disclosed herein, the pressure regulator 110 may include a manifold sensor 142 sited upstream of the solenoid valve between the solenoid valve 140 and the pressurized cylinder assembly 170. The manifold sensor 142 may be configured to sense a pressure and temperature of the regulated oxygen flow 176 flowing from the cylinder assembly 170. For example, the manifold sensor 142 may routinely read the 16 to 30 psig and routinely sense an approximate regulated oxygen gas temperature supplied by the source regulator 174.

In one embodiment of the inventive concepts disclosed herein, downstream of the solenoid valve 140, a flow pressure sensor 144 may sense an absolute pressure that the solenoid valve 140 may produce. When the solenoid valve 140 is commanded to an open position, the flow pressure sensor 144 may routinely sense a bolus pressure of the variable bolus of oxygen 146 which may approximate the pressure found proximal with the manifold sensor 142. When power is removed from the solenoid valve 140 allowing it to close, the flow pressure sensor 144 may read the pressure within the flexible tubing leading to the enclosed breathing environment 150.

Additional types of solenoid valves may function within the scope of the inventive concepts herein. For example, one valve type may be configured with a latch remaining in either the open position or the closed position without addition power input after being driven to that point.

In some embodiments, a mode input 156 may function to receive a mode of operation and transmit the mode of operation to the pressure regulator 110, the mode input being reflective of the quantity of flow required of the regulator by the enclosed breathing environment In one embodiment of the inventive concepts disclosed herein, the enclosed breathing environment 150 may be a defined volume of a pressure suit worn by the user and configured for mobile activity in a near zero or zero-pressure ambient environment (e.g., extra vehicle activity). In other embodiments, the pressure regulator 110 may function with the enclosed breathing environment 150 of a defined volume of a pressurized compartment associated with a vehicle and a pressurized compartment associated with a surface structure.

In one embodiment of the inventive concepts disclosed herein, the pressure regulator 110 may include a precision fixed orifice 148 sited between the flow pressure sensor 144 and the enclosed breathing environment 150. The precision fixed orifice 148 may function to restrict a flow of the variable bolus of oxygen 146 to the enclosed breathing environment 150 which may define the flow to the enclosed breathing environment 150 to meet demand. The flow across the precision fixed orifice 148 may be choked (sub-sonic as well as sonic) causing a discernable change in pressure immediately upstream of the orifice that this being sensed by the flow pressure sensor 144.

Downstream of the precision fixed orifice 148, a pressure attenuating plenum 166 with an exemplary size of one liter may function to normalize the pressures reaching the enclosed breathing environment 150 and reduce a physical pressure impact on a user within the enclosed breathing environment 150.

In one embodiment of the inventive concepts disclosed herein, the pressure manifold 130 may be configured to receive the flow of pressure regulated oxygen 176 from the pressurized cylinder assembly 170 and supply one or more solenoid valves 140 with the flow of pressure regulated oxygen 176. The pressure manifold 130 may be further configured to route the variable bolus of oxygen 146 to the enclosed breathing environment 150 through the precision fixed orifice 148.

In one embodiment of the inventive concepts disclosed herein, the pressure regulator 110 may be controlled by a microcontroller 120 (sometimes indicated as microcontroller unit (MCU)) associated with the pressure manifold 130. The microcontroller 120 may be operatively coupled with 1) a cylinder pressure sensor 178 associated with the pressurized cylinder assembly 170, 2) the manifold sensor 142, 3) the solenoid valve 140, 4) the flow pressure sensor 144, the 5) the regulated output sensor 164, and, in some embodiments, 6) an enclosure sensor 152. The microcontroller 120 may operatively couple with each of the above elements for not only control and sensing but also for circuit connectivity and operational test for a periodic built-in-test (BIT) of each element and its associated circuitry. To communicate a BIT result, the pressure regulator 110 may include a BIT and operational indicator 124 which may provide a visual indicator to the user as well as externally transmit a BIT result.

In one embodiment of the inventive concepts disclosed herein, the microcontroller 120 may be further configured to monitor suit data from one or more enclosure sensors 152 (FIG. 2) associated with, and able to sense conditions within, the enclosed breathing environment 150 as well as a condition of the occupant. Here, one parameter available to the microcontroller 120 may include a volume of the enclosed breathing environment 150, a desired environment internal pressure, and a current environment internal pressure and temperature. An enclosure health monitor 154 may also provide means available to the microcontroller 120 to externally transmit general pressure regulator health as well as additional parameters. For example, one suit health input may be associated with the BIT function sent via the CAN (FIG. 5) also reporting an operational state of the microcontroller 120 and an initiator within the cylinder assembly 170.

The pressure regulator 110 may receive a standard power of 28 volts dc power 160 as well as a 28*v* source of BIT dc power 162.

The pressure regulator 110 may also include a tangible, non-transitory memory 122 configured to communicate with the microcontroller 120, the tangible, non-transitory memory 122 may have instructions stored therein that, in response to execution by the microcontroller 120, may cause the microcontroller 120 to carry out each function of the pressure regulator 110. In one embodiment, the memory 122 and microcontroller 120 may be implemented as based on a Field Programmable Gate Array (FPGA).

System Function

In one embodiment of the inventive concepts disclosed herein, the microcontroller 120 may monitor the bolus pressure via the flow pressure sensor 144 and a manifold data via the manifold sensor 142. Here, the manifold data may include a manifold pressure and a manifold temperature. The microcontroller 120 may also monitor a regulated output data via the regulated output sensor 164. Here, the regulated output data may include the regulated output pressure and the regulated output temperature.

In embodiments, to begin operation, the microcontroller 120 may send an initiator signal 272 to the pressurized cylinder assembly 170 to initiate the flow of pressure regulated oxygen. The microcontroller 120 may provide an initiator power signal to a pyrotechnic initiator resident in the oxygen cylinder 172. The regulator 174 may provide the regulated oxygen flow 176 to the pressure regulator 110 routed by means of the pressure manifold 130.

The microcontroller 120 may further monitor the bolus pressure of the variable bolus of oxygen 146 via the flow pressure sensor 144. As the flow pressure sensor may measure the pressure just downstream of the solenoid valve 140, the microcontroller may use the signals from the flow pressure sensor 144 as an indication that the solenoid valve 140 is an open position or a closed position. If open, the flow pressure sensor 144 may read approximately the same pressure as sensed by the manifold sensor 142. If closed, the flow pressure sensor 144 may sense similar pressure (slightly greater because of loss) as sensed by the regulated output sensor 164 or in the enclosed breathing environment 150.

As the microcontroller 120 provides function to the pressure regulator 110, whether a solenoid valve 140 is in the open position or the closed position may be valuable information for feedback to the microcontroller 120. In embodiments, the flow pressure sensor 144 may provide this feedback of solenoid valve 140 position based on the bolus pressure measured by the flow pressure sensor and thereby determine if the solenoid valve is operating as intended.

In one embodiment of the inventive concepts disclosed herein, the microcontroller 120 may also monitor manifold data from the manifold sensor 142. Here, the manifold data may include a manifold pressure as well as a manifold temperature. One input to the microcontroller 120 determination of how long to open each solenoid valve 140 may include the pressure temperature upstream of each solenoid valve 140. Here, the manifold data may be consistent throughout the manifold. For example, one possible value for manifold pressure may be between 16-30 psig. Should the manifold pressure be higher relative to a nominal value, the microcontroller 120 may determine a shorter duration for each solenoid valve 140 to open to achieve the desired variable bolus of oxygen 146 sent to the enclosed breathing environment 150.

The microcontroller 120 may also monitor ambient data from an ambient sensor 180. Here, the ambient data may include an ambient pressure and an ambient temperature. As some enclosed breathing environment 150 may be flexible or have known structural limitations (e.g., a pressure suit or habitat), ambient conditions may be an additional factor for the microcontroller 120 to determine a volume of the variable bolus of oxygen 146 to send to the enclosed breathing environment 150 in order to maintain the required pressure differential between the enclosure and the surrounding ambient environment.

In one embodiment of the inventive concepts disclosed herein, the pressure regulator 110 may be specifically configured for a pressure suit which may include pressure relief valves within the suit to prevent rupture. The pressure regulator 110 may function to regulate pressure in the suit or in a protected enclosure. The inventive concepts disclosed herein may be directly applicable to regulating pressure to support space station modules, human habitats, landers etc. The pressure regulator 110 may employ oxygen and nitrogen separately or blended as Nitrox from a single cylinder assembly 170. The microcontroller 120 may actively monitor an operational state of the pressure regulator 110 and cylinder assembly 170 supporting the desired environment.

In one embodiment of the inventive concepts disclosed herein, the microcontroller 120 may determine an adjusted pulse width (APW) and a pulse interval based on one or more of the modes of operation, the bolus pressure, the regulated output pressure and the manifold data. The APW may be described as the duration of the power signal sent to one solenoid valve 140 to command the solenoid valve 140 to the open position. The pulse interval may be described as a frequency that the APW may be repeated.

In one embodiment of the inventive concepts disclosed herein, In the absence of valid data, the microcontroller 120 may employ an initial pulse width (IPW). The microcontroller 120 may compensate each APW for manifold gas pressure and temperature. The IPW may be derived from the control law that is dependent on the regulated output pressure and temperature sensor. Separately, the IPW may be derived directly from the enclosed breathing environment 150 (suit) pressure and temperature sensor.

In some embodiments of the inventive concepts disclosed herein, the pressure manifold 130 may be configured with a plurality of solenoid valves 140. In this situation, the APW may still be described as a duration each individual valve is commanded open. However, the pulse interval may be described as the frequency of each cycle of valves being commanded open. For example, with a two solenoid valve 140 configuration, the microcontroller 120 may command each valve to open at an equal or unequal IPW while each solenoid valve 140 may receive a command to open within the pulse interval at a 180 phase angle.

In this basic example, at a pulse interval of 5 seconds, each solenoid valve 140 may be commanded open for the APW (e.g., 250 ms) at a 5 second pulse interval. While one of the two solenoid valves 140 may be commanded open every 2.5 seconds. To open the solenoid valve 140 the microcontroller 120 may apply a timed power pulse to the solenoid valve 140 to the open position for the duration of the APW and at the pulse interval to produce the variable bolus of oxygen 146.

In one embodiment of the inventive concepts disclosed herein, in a four solenoid valve 140 configuration with three of the solenoid valves 140 acting as operational valves, the microcontroller 120 may command a (120) one hundred twenty degree phase between each opening of three operational valves within the determined pulse interval. Here, the fourth of the quad valve embodiment may function as a pressure relief valve to protect the integrity of the enclosed breathing environment 150 should the manifold pressure exceed a certain threshold. In this example, at the exemplary pulse interval of 5 seconds, a solenoid valve 140 would be commanded open every 1.66 seconds and remain open for the duration of the APW.

The microcontroller 120 may further continuously adjust the pulse interval and the IPW to an adjusted pulse width (APW) based on the manifold data. Once adjusted, the microcontroller 120 may apply the timed power pulse to the solenoid valve(s) 140 to the open position for the duration of the APW at an adjusted pulse interval to produce the variable bolus of oxygen 146.

In embodiments, the APW duration may vary inversely with respect to a manifold oxygen pressure correction (Kp) and in direct proportion with offset to an oxygen temperature correction (Kt). As the ambient sensor 180 senses temperature (Ta) and ambient pressure (Pa), the microcontroller 120 may continuously update the APW. Further, the microcontroller 120 may use serialized manifold data (pressure and temperature) measured at specific intervals while the solenoid valve 140 is open, the pressure sensor being temperature compensated for between approximately −15° C. and +70° C.

In one embodiment of the inventive concepts disclosed herein, the microcontroller 120 may command a reading of manifold pressure and temperature from the manifold sensor 142 while oxygen is flowing just after a solenoid valve 140 has been commanded open. If the manifold gas pressure measurement may fall out of a range of 3 to 60 psia, or manifold gas temperature measurement may fall out of the range of −15° C. to +55° C., the correction factors for that measurement (Kp or Kt) may become a one (1) corresponding to a nominal set of operating parameters. In embodiments, the APW may be calculated as a product of IPW and manifold data While the pressure regulator 110 is operational supplying the variable bolus of oxygen 146 to the enclosed breathing environment 150, the microcontroller 120 may provide the regulated output data from the regulated output sensor 164 at specific intervals (e.g. phased with the delivery of each oxygen pulse or at a specific time interval). A failure of the regulated output sensor 164 function may result in a loss of input to the microcontroller 120. Should the regulated output sensor 164 measurement and the corresponding calculated pulse width be unavailable for a period greater than 15 seconds the microcontroller 120 may employ a default IPW corresponding to Mode 3 operation. The microcontroller 120 may continue to provide a flow of oxygen until the main power 160 is inactive or the oxygen supply to the pressure regulator 110 is reduced to below a certain pressure level.

For example, should the pressure in the pressure manifold 130 change, the microcontroller 120 may adjust the indicated pulse width IPW to the APW to account for the difference in manifold pressure. Similarly, should one of the other variables change, the microcontroller 120 may sense that change and further adjust the APW to support the desired pressure within the enclosed breathing environment 150.

A combined minute average flow rate may be described as a flow rate from at least one or all solenoid valve 140 associated with the pressure manifold 130. A pressure regulation of approximately 4.7 psia may be one desired target value the pressure regulator 110 may produce within the enclosed breathing environment 150. APW and IPW may indicate the duration the microcontroller 120 may command each solenoid valve 140 to open.

For example, should the microcontroller 120 sense within the pressure manifold 130 a manifold pressure of 16 psig and temperature of 23 C, it may open one of the solenoid valves 140 for a specific period to reach the desired flow rate into the enclosed breathing environment 150. Conversely if the microcontroller 120 senses 30 psig within the pressure manifold 130, it may open one of the solenoid valves 140 for a shorter duration. Similarly, the microcontroller 120 may command a longer APW based on an increased flow demand to the enclosed breathing environment 150 (e.g., as a result of a change in suit environmental condition) to maintain desired pressure within the enclosed breathing environment 150.

In one embodiment of the inventive concepts disclosed herein, the microcontroller may also monitor a mode of operation associated with the enclosed breathing environment via the mode input 156. In embodiments, the mode of operation may define a change in outflow from one or more apertures within the enclosed breathing environment 150, a pressurization schedule for the enclosed breathing environment 150 to pressurize the enclosed breathing environment 150 based on a plurality of pressurization factors. Pressurization factors may include an anticipated enclosed breathing environment 150 internal pressure, an anticipated enclosed breathing environment 150 internal temperature, and an anticipated oxygen consumption by the user within the enclosed breathing environment 150.

In embodiments, the mode of operation may include four or more modes of operation. A first mode of operation may enable the microcontroller to command an APW to comply with a first flow rate flowing to the enclosed breathing environment 150. A second mode of operation may enable the microcontroller to command an APW to support a second flow rate (greater than the first) flowing to the enclosed breathing environment 150. A third mode of operation may enable the microcontroller to command an APW to support a third flow rate (greater than the second) flowing to the enclosed breathing environment 150. And a fourth mode of operation may enable the microcontroller to relieve pressure from the enclosed breathing environment 150 to account for an overpressure situation.

A mode 1 may be described as associated with a normal metabolic breathing requirement of the user. Here, one user may be unique from another user. Each mode 1 may vary as associated with a specific user. User size, user gender, user lung function and capacity may be some variables which enable the microcontroller 120 to vary the APW based on a specific user operating under mode 1.

A mode 2 operation may be associated with a defog of a suit visor as well as a physical activity of the user. For example, once the user may begin physical activity, the metabolic rate and oxygen consumption may increase leading the microcontroller 120 to increase the APW to a longer duration to meet the demand. Similarly, an additional mode 2 operation may include a loss of a suit integrity where a slight leak in the enclosed breathing environment 150 may consume additional breathing gas from within the enclosed breathing environment 150.

A mode 3 operation may be associated with one of a cooling mode of the suit as well as a loss of one or more functions of the suit. For example, should the microcontroller 120 determine additional cooling may be necessary, it may increase the APW to allow for the additional flow for cooling. Also, under normal operations, the enclosed breathing environment 150 may maintain additional systems which may remove undesirable gasses (e.g., CO2) from the enclosed breathing environment 150. Should one or more of those additional systems fail, the microcontroller 120 may increase the APW to enable additional volume of the variable bolus of oxygen 146 into the enclosed breathing environment 150. In this manner, the pressure regulator 110 may offset a failure of other separate systems associated with the enclosed breathing environment 150.

A mode 4 operation may be associated with a solenoid valve 140 failure in the open position where unrestricted flow of the pressure regulated flow 176 may enter the enclosed breathing environment 150 limited only by the precision fixed orifice 148. Here, the microcontroller 120 may limit the combined minute flow average by limiting the APW or other solenoid valves 140 to allow a flow rate to offset the failed open solenoid valve 140. An integrity of the enclosed breathing environment 150 may be of primary concern as continuous unrestricted flow may lead to a structural failure of the enclosed breathing environment 150 (e.g., suit or habitat rupture failure).

Closed Loop Control

In order to maintain or account for variability in flow demand on the microcontroller 120, the pressure is measured downstream of the solenoid valve 140 at a rate no less than 20 samples per second (20 Hz). This may be the default rate to support sensor measurement accuracy but may be reduced or increased as needed to within sensor limits (e.g., 2 kHz). The temperature compensated pressure values may be processed by an appropriate filtering technique for the system to obtain a regulated pressure measurement estimate. This information is then used by the microcontroller 120 to vary the APW duration to maintain regulated output pressure under steady state conditions and during step transition in enclosed breathing environment 150 flow states.

In embodiments, the microcontroller 120 may function under a control law of proportional-integral-derivative (PID). The normal steady operating limits for the variable bolus of oxygen 146 outlet pressure is defined by the set point stored in the microcontroller. Since excess enclosed breathing environment 150 pressure may only be bled from the enclosed breathing environment 150, the microcontroller 120 design combined with solenoid valve 140 flow performance may be intended to limit pressure overshoot within defined limits while addressing an increase in flow demand. Enclosed breathing environment 150 flow and pressure conditions may be otherwise relative stable for the majority of the time that the enclosed breathing environment 150 is in use.

One control law method employed by the microcontroller 120 may include a look-up table containing the Kp, Ki and Kd factors supporting the steady state and transient system control function. The microcontroller 120 may reference the K factor table values based on an assessment of the regulated output pressure estimate and the specified control limits. The look-up table K factors may be established empirically by testing each microcontroller 120 or numerically considering variation in pressure suit/user (e.g., astronaut) characteristics or individual microcontroller 120 behavior.

Referring now to FIG. 2, a detail block diagram of an enclosed system breathing environment pressure regulator in accordance with an embodiment of the inventive concepts disclosed herein is shown. In one embodiment of the inventive concepts disclosed herein, the microcontroller 120 may receive input from the suit or enclosure sensor 152. This suit or enclosure data analyzed with one or more of the additional variables may enable the microcontroller 120 to accurately adjust the APW and the adjusted pulse interval to accurately maintain the desired pressure within the enclosed breathing environment 150.

FIG. 3

Figure 3:
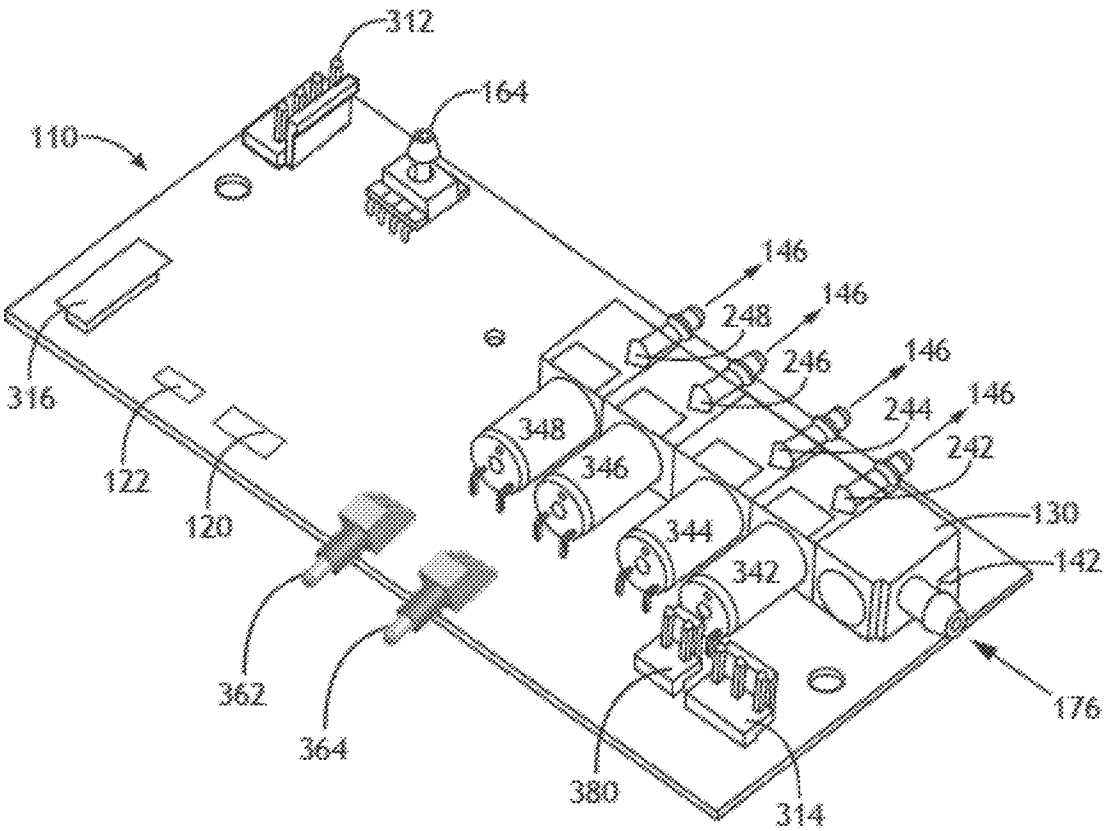
FIG. 3 is a diagram of a pressure regulator controller assembly exemplary of an embodiment of the inventive concepts disclosed herein.

Referring now to FIG. 3, a diagram of a pressure regulator controller assembly exemplary of an embodiment of the inventive concepts disclosed herein is shown. The pressure regulator 110 may function enclosed within an oxygen controller assembly 300 for ease of implementation, integration to an existing pressure system, and transport in a mobile application. The microcontroller 120 may illuminate a BIT indicator 362 and a flow indicator 364 functional to alert the user of positive or negative system performance.

Here, an exemplary four solenoid valve 140 configuration may be shown. Each of a solenoid valve 1 242, solenoid valve 2 244, solenoid valve 3 246, and solenoid valve 4 248 may be conveniently mounted associated with the pressure manifold 130. Each solenoid valve 140 may be driven by its respective solenoid including solenoid 1 342, solenoid 2 344, solenoid 3 346, and solenoid 4 348.

Additional elements may include a power connector 312 connecting the pressure regulator 110 to the power source, a cylinder initiator connector 314 enabling the microcontroller 120 to command the cylinder 172 to begin the flow. A programming port 316 enabling a controller area network (CAN) bus may be functional to support the adaptability of the pressure regulator 110 to a variety of applications and a variety of modes of operation. The CAN bus may enable addition function including external control in place of the regulated output sensor 164, and may act as an interface to enclosure health monitoring (e.g. BIT message) and control the desired pressure within the enclosed breathing environment 150.

The pressure regulator 110 may be customized or optimized across a range of regulated output pressures or enclosed breathing environment 150 systems have differing ventilation characteristics. This control may be achieved by providing a numeric scalar value to the microcontroller 120 defining the desired range of pressure (e.g., 0-8000 scaler value may represent the current suit regulator from 0 psia to 8.4 psia). A plurality of sensor connectors enabling the microcontroller 120 to receive signals from each sensor including the regulated output sensor 164 and an ambient connector 380.

In one embodiment of the inventive concepts disclosed herein, the manifold sensor 142 and regulated output sensor 164 may be incorporated as a solid-state microelectromechanical systems (MEMs) sensor to measure regulated output pressure and temperature conditions. The microcontroller 120 may adjust the regulated output pressure measurement based on the regulated output sensor 164 temperature conditions at that time to compensate for variance in pressure measurements characteristic of the sensor. The microcontroller 120 may use the manifold sensor 142 (pressure and temperature) inputs to vary the APW as a means to account for pressure regulator 110 performance across a range of oxygen supply pressures and temperatures. In the absence of valid data from the regulated output manifold sensor 142, the microcontroller 120 may default to a pre-defined IPW or an external measurement if present. If the manifold data may fall out of range the microcontroller 120 may apply no IPW correction.

FIG. 4

Figure 4:
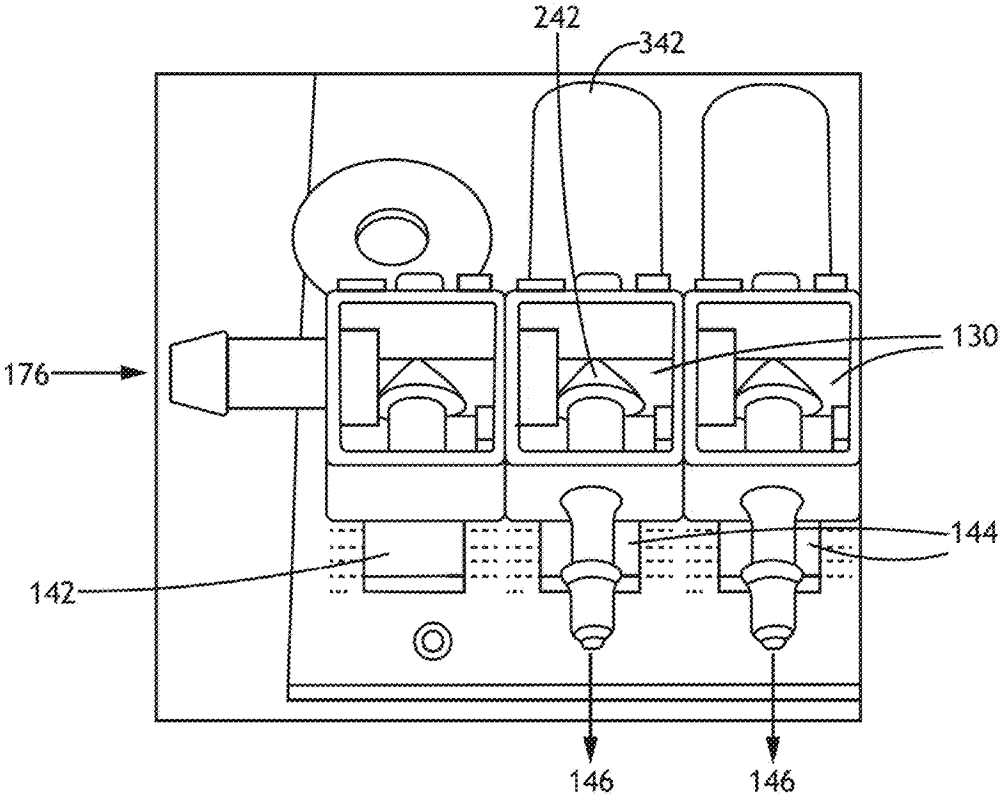
FIG. 4 is an exploded view of a manifold assembly exemplary of one embodiment of the inventive concepts disclosed herein.

Referring now to FIG. 4, an exploded view of a manifold assembly exemplary of one embodiment of the inventive concepts disclosed herein is shown. Here, a two solenoid valve 140 manifold assembly 400 may be shown where the solenoid valve 140 may function at a 180 degree phase within the pulse interval.

FIGS. 5A, B AND C

Figure 5A:
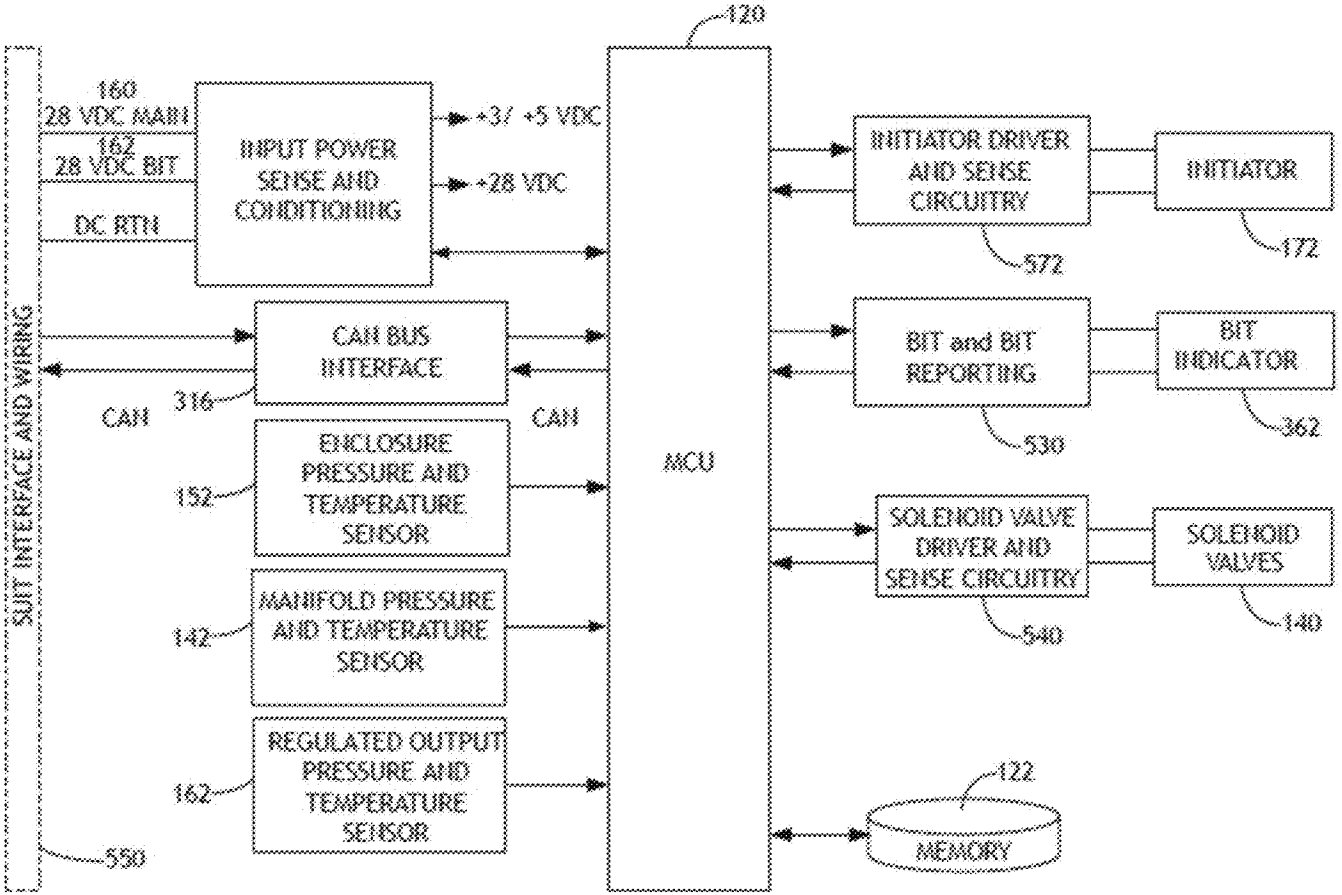
FIGS. 5A-5C are diagrams of pressure regulator function and logic in accordance with one embodiment of the inventive concepts disclosed herein.
Figure 5B:
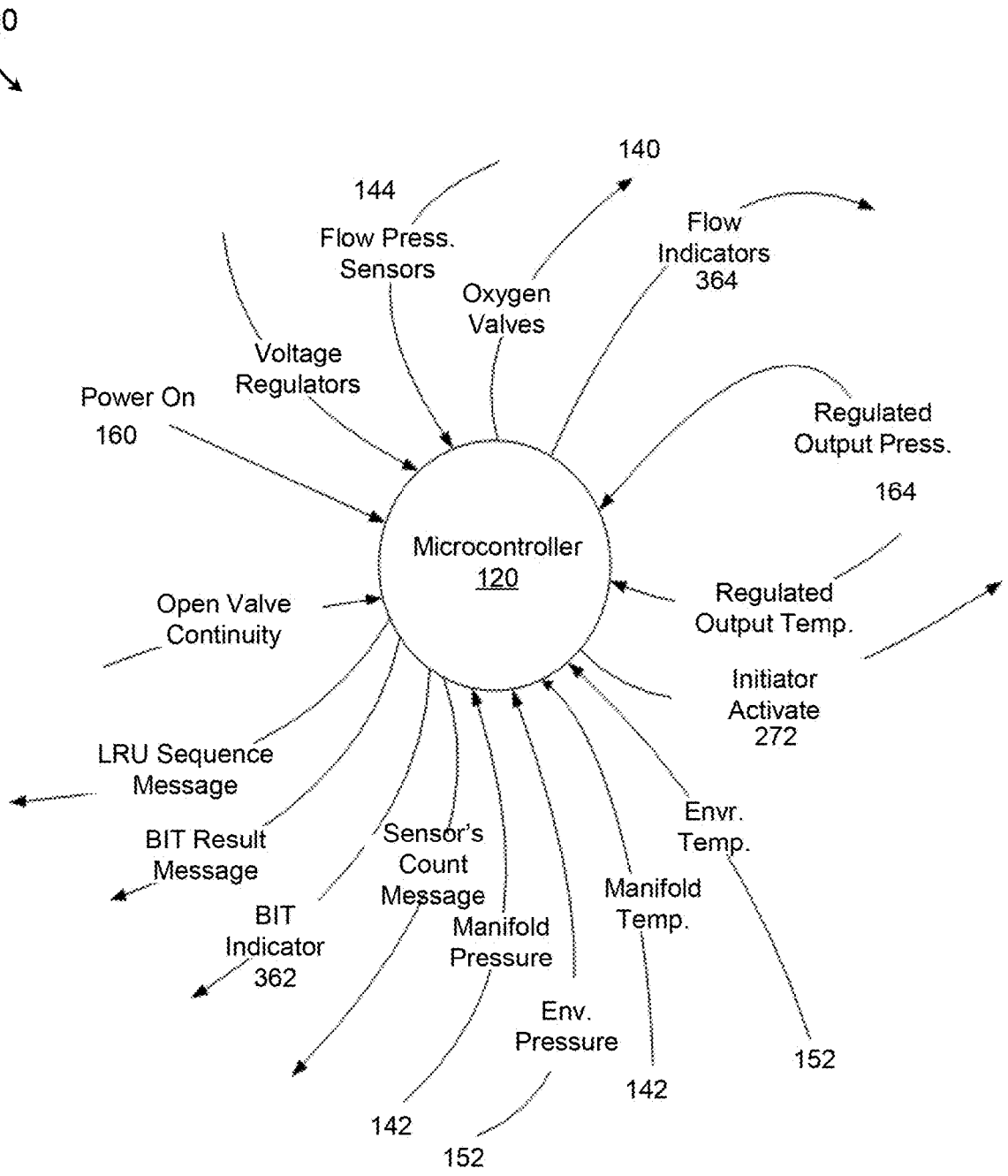
Figure 5C:
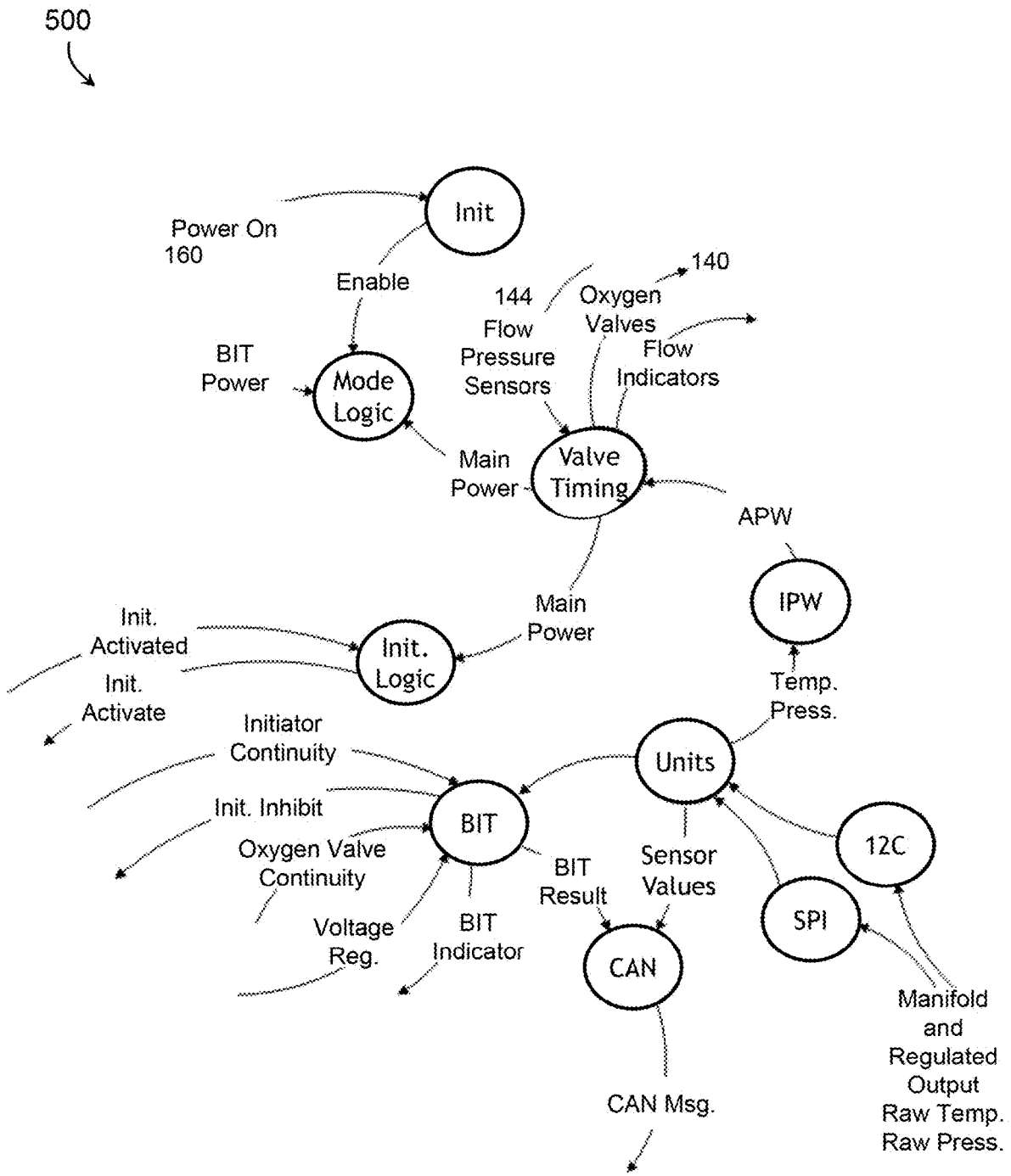

Referring now to FIGS. 5A-5C, are diagrams of pressure regulator function and logic in accordance with one embodiment of the inventive concepts disclosed herein is shown. Here, an oxygen controller functional diagram 500 may illustrate function of one embodiment of the inventive concepts disclosed herein. In one embodiment of the inventive concepts disclosed herein, the two power supplies may provide electrical power to the pressure regulator 110: 28 VDC #1—Main and 28 VDC #2—BIT. Each power input may be transient suppression protected and diode isolated to support segregation requirements at the level of the enclosed breathing environment 150.

A suit interface 550 may function for the microcontroller 120 to communicate with a variety of enclosed breathing environment 150 including pressure suits from a plurality of manufacturers. Each separate sensor may function within its own type of communication bus. Here, the CAN bus may enable the microcontroller 120 to communicate with a suit interface 550, a serial peripheral interface (SPI) may enable a variety of Enclosure Sensors to communicate with the microcontroller 120, and a system management bus (SMBus) $I^2C$ bus may enable microcontroller 120 communication with a plurality of sensors within the pressure regulator 110.

In one embodiment of the inventive concepts disclosed herein, these supplies may be configured allowing any combination of power inputs may be used to provide electrical power to the microcontroller 120. An input power sense and conditioning circuit 560 may enable the microcontroller 120 to ensure input power and operational requirements are met (e.g., within range, or not, determine if the controller is in BIT or operational mode) before the microcontroller 120 commands system operation. The microcontroller 120 may command 3 stages of operation: power-up/initialization, BIT, and deliver/operational. Each electrical circuit within the pressure regulator 110 may be protected or isolated from the effects of electromagnetic interference (EMI) as well as high-intensity radiated field (HIRF) both during use and storage.

A solenoid valve driver and sense 540 may function between the microcontroller 120 and each solenoid valve 140 to send the open command to each solenoid valve 140. An initiator driver and sense circuitry 572 may similarly drive the initiator and allow a BIT of the initiator bridge wire circuit continuity.

In one embodiment of the inventive concepts disclosed herein, the microcontroller 120 may be further configured to periodically perform a built-in-test (BIT) 530 of each of: a circuit continuity associated with the initiator circuit, the manifold sensor 142, the flow pressure sensor 144, a circuit continuity associated with the solenoid valve 140, an operation of the at least one solenoid valve 140, the IPW, and the APW. The microcontroller 120 may retain results of the periodic BIT within the memory 122, transmit results to the user via the suit interface 550, and transmit results offboard to an external monitor.

In some embodiments, the microcontroller 120 may initiate a BIT of the Initiator circuit continuity, Solenoid valve continuity, Input power levels from each of the power supplies, enclosed breathing environment 150 environment, oxygen manifold pressure and temperature sensor range and readiness check, and a microcontroller 120 internal functions by cyclic redundancy code (CRC) check and SRAM test.

FIGS. 5B and 5C may detail logic values usable by the microcontroller 120. Here, a plurality of logic inputs to the microcontroller 120 may include: flow pressure sensors, flow indicators, oxygen valves, voltage regulators, power on, regulated output pressure and temperature, bit, door latch continuity, open valve continuity, line replaceable unit (LRU) sequence message, bit result message, sensor's count message, environment temperature and pressure, and manifold temperature and pressure.

FIG. 5C may further detail Logic and Information flows and orientation. Here, one exemplary orientation of logic the microcontroller 120 may employ may include an initialization of the pressure regulator 110 and associated systems with a power on status, mode logic, valve timing, IPW, units usable by the enclosed breathing environment 150, BIT, and configuration of each bus including the CAN, SPI and I2C busses.

FIG. 6

Figure 6:
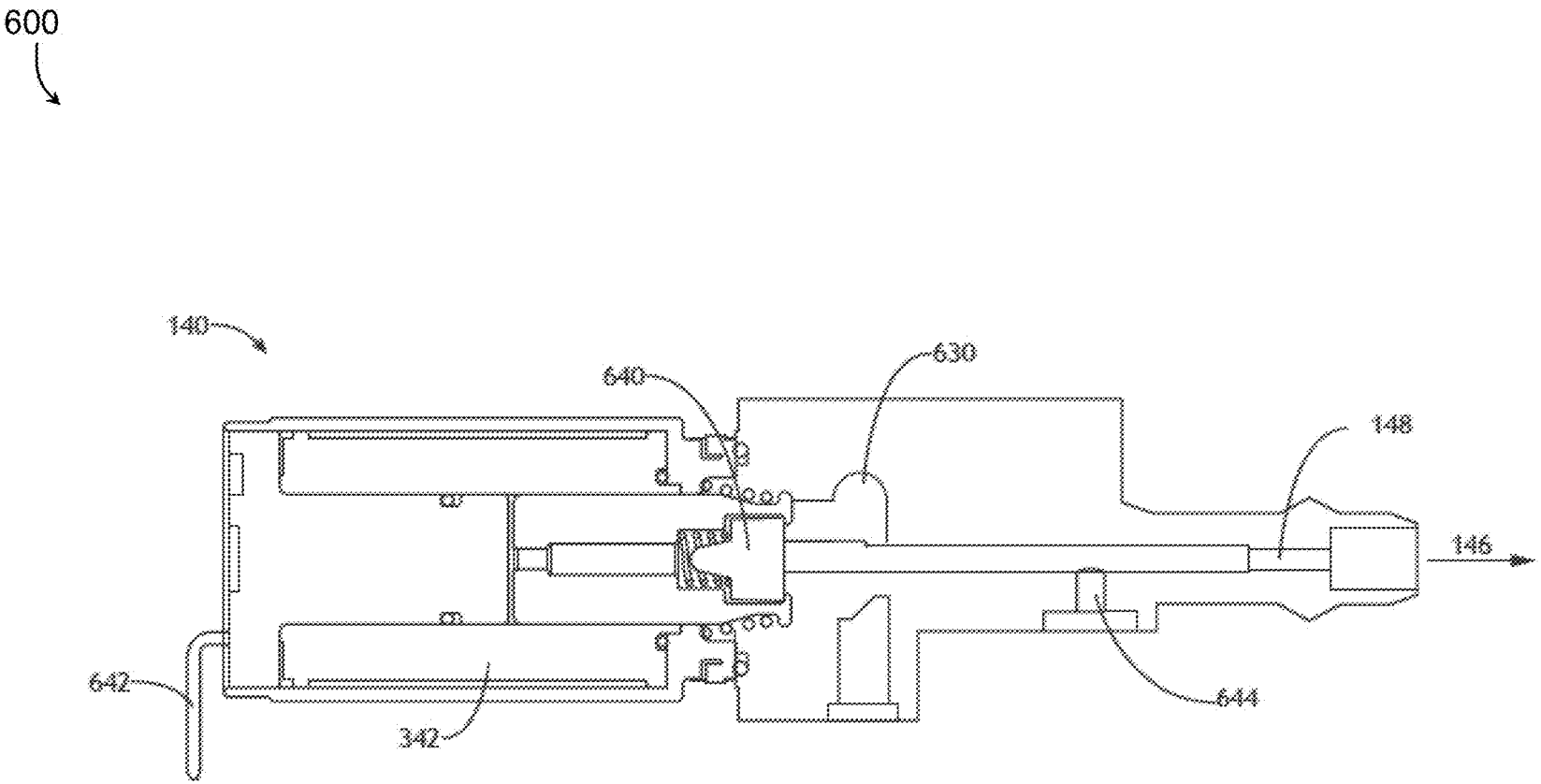
FIG. 6 is a cross section diagram of an exemplary solenoid, valve and manifold in accordance with one embodiment of the inventive concepts disclosed herein.

Referring now to FIG. 6, a cross section diagram of an exemplary solenoid, valve and manifold in accordance with one embodiment of the inventive concepts disclosed herein is shown. A cross section view 600 of one solenoid valve 140 may indicate a gas flow through the solenoid valve 140 when commanded open. A manifold plenum 630 may supply each solenoid valve 140 from the pressure regulated oxygen flow 176 from the cylinder assembly 170. When the solenoid valve 140 in the closed position, a poppet 640 may seat limiting or controlling gas flow through the solenoid valve 140. A power signal sent by the microcontroller 120 may be received by a solenoid terminal 642 and applied to the solenoid 342 to pull the poppet 640 away from the seat enabling oxygen to flow through the solenoid valve 140. The precision fixed orifice 148 may limit the flow of the variable bolus of oxygen 146 before the bolus is able to exit. A flow pressure sensing port 644 sited in the volume between the seated poppet 640 and the precision fixed orifice 148 may provide a location for which the flow pressure sensor 144 monitors the pressure.

In one embodiment of the inventive concepts disclosed herein, the operational solenoid valve(s) 140 may independently function separated by the 120 degree phase angle.

The enclosed system breathing environment pressure regulator 110 may add redundancy via a second pressure regulator 110 coupled in parallel with a first pressure regulator 110. In one embodiment, a primary and a secondary pressure regulator 110 may be employed to provide redundancy. Failures of concern may be related to the oxygen supply source, to the pressure regulator 110 in which case independent primary and secondary pressure regulators may each comprise an oxygen source and pressure regulator 110. The individual systems may be similar but the secondary may operate at a lesser regulated output pressure (e.g. primary 5.0+/−0.3 psia, secondary 3.5+/−0.3 psia) so that the primary is dominant in a common distribution system. If the primary degrades or is lost, the secondary immediately becomes active in place of or in support of the primary.

FIG. 7

Figure 7:
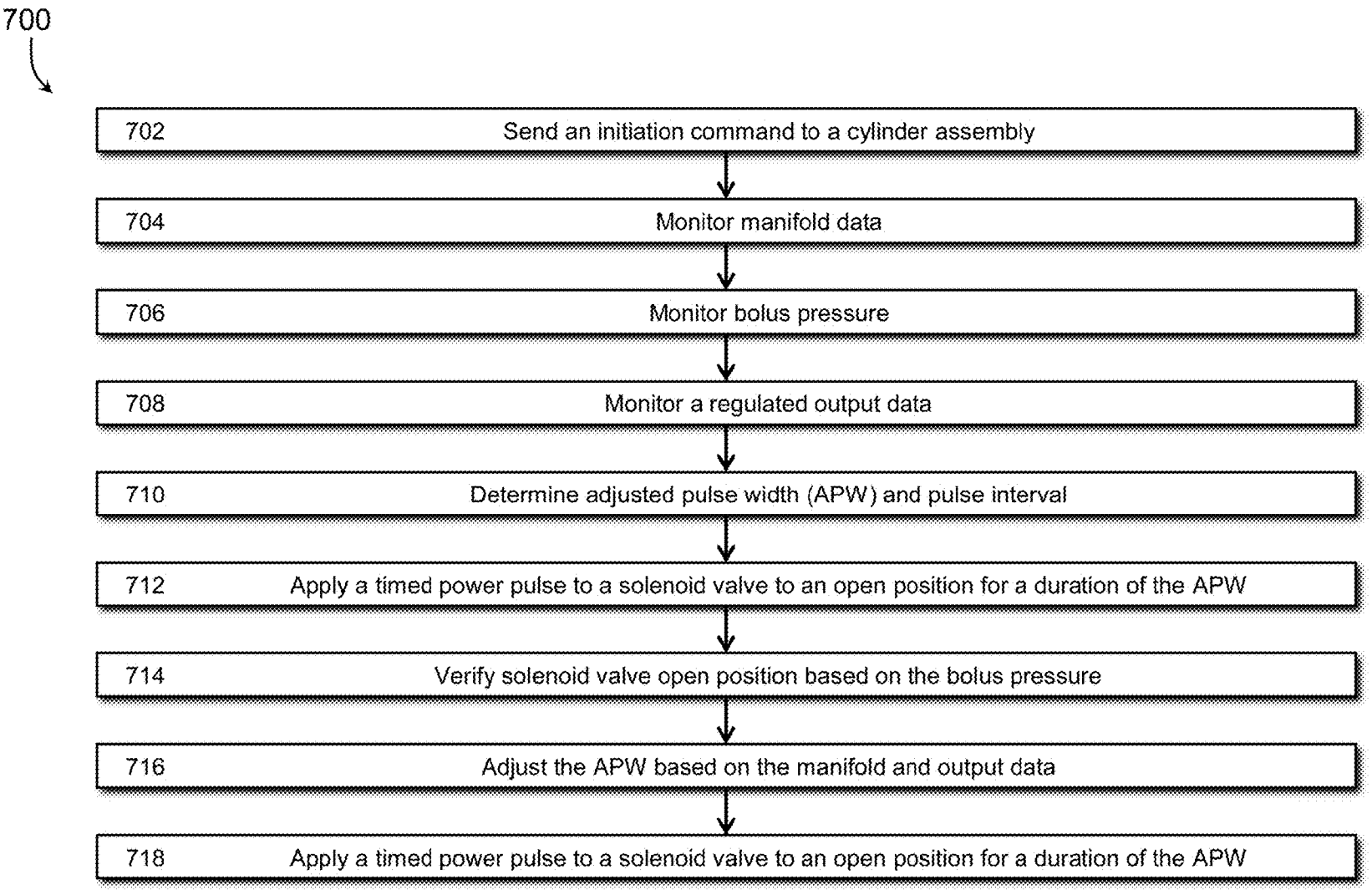
FIG. 7 a diagram of a method flow associated with one embodiment of the inventive concepts disclosed herein.

Referring now to FIG. 7, a diagram of a method flow associated with one embodiment of the inventive concepts disclosed herein is shown. A method 700 for regulating pressure within an enclosed system breathing environment may include, at a step 702, sending an initiation command to a cylinder assembly to initiate a flow of pressure regulated oxygen, and, at a step 704, monitoring a manifold data from at least one manifold sensor associated with a pressure manifold which receives a flow of pressure regulated oxygen from the cylinder assembly, the manifold data including a manifold pressure and a manifold temperature.

A step 706 may include monitoring a bolus pressure via a flow pressure sensor and, at a step 708, monitoring a regulated output data via a regulated output sensor sited between the flow pressure sensor and an enclosed breathing environment, the regulated output sensor configured to measure a regulated output pressure and a regulated output temperature.

A step 710 may include determining an adjusted pulse width (APW) and a pulse interval based on the regulated output data and the manifold data and at a step 712, applying at least one timed power pulse to at least one solenoid valve to an open position for a duration of the calculated APW at the pulse interval to produce a variable bolus of oxygen supplied to the enclosed breathing environment.

A step 714 may include verifying the open position of the at least one solenoid valve based on the bolus pressure and, at a step 716, continuously adjusting the APW based on each of: the regulated output data and the manifold data. A step 718 may include applying the at least one timed power pulse to the at least one solenoid valve to the open position for a duration of the APW at the pulse interval to produce the variable bolus of oxygen supplied to the enclosed breathing environment.

CONCLUSION

As will be appreciated from the above description, embodiments of the inventive concepts disclosed herein may provide a novel solution to efficiently adapt to a plurality of pressure environment volume, ambient conditions, and pressurization requirements without requiring a cumbersome mechanical replacement.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. An enclosed system breathing environment pressure regulator, comprising:

a pressure manifold coupled with a pressurized cylinder assembly and an enclosed breathing environment, the pressure manifold including:

at least one solenoid valve configured to produce a variable bolus of oxygen when powered to an open position;

at least one manifold sensor sited between the at least one solenoid valve and the pressurized cylinder assembly;

at least one flow pressure sensor sited between the at least one solenoid valve and the enclosed breathing environment, the flow pressure sensor configured to measure 1) a bolus pressure of the variable bolus of oxygen and 2) a function of the at least one solenoid valve;

a regulated output sensor sited between the flow pressure sensor and the enclosed breathing environment, the regulated output sensor configured to measure a regulated output pressure and a regulated output temperature;

the pressure manifold configured to receive a flow of pressure regulated oxygen from the pressurized cylinder assembly and supply the at least one solenoid valve with the flow of pressure regulated oxygen, the pressure manifold further configured to route the variable bolus of oxygen to the enclosed breathing environment;

a microcontroller associated with the pressure manifold and operatively coupled with 1) at least one oxygen cylinder pressure sensor associated with the pressurized cylinder assembly, 2) the manifold sensor, 4) the at least one solenoid valve, 4) the flow pressure sensor, and 5) the at least one regulated output sensor;

a tangible, non-transitory memory configured to communicate with the microcontroller, the tangible, non-transitory memory having instructions stored therein that, in response to execution by the microcontroller, cause the microcontroller to:

monitor the bolus pressure via the flow pressure sensor;

monitor a manifold data via the at least one manifold sensor, the manifold data including a manifold pressure and a manifold temperature;

monitor a regulated output data via the regulated output pressure sensor, the regulated output data including the regulated output pressure and the regulated output temperature;

send an initiation command to the pressurized cylinder assembly to initiate the flow of pressure regulated oxygen;

determine an adjusted pulse width (APW) and a pulse interval based on the manifold data and a temperature-compensated regulated output pressure;

apply at least one timed power pulse to command the at least one solenoid valve to the open position for a duration of the APW at the pulse interval to produce the variable bolus of oxygen;

verify the open position of the at least one solenoid valve based on the bolus pressure;

continuously adjust the APW based on the temperature-compensated regulated output pressure and the manifold data.

2. The enclosed system breathing environment pressure regulator of claim 1, wherein the microcontroller is further configured to receive a mode of operation of the pressure regulator, the mode of operation associated with the enclosed breathing environment and defines a pressurization schedule for the enclosed breathing environment based on at least one of: an anticipated environment internal pressure, an anticipated environment internal temperature, and an anticipated oxygen consumption by a user within the enclosed breathing environment, the mode of operation further comprises at least four modes: a first mode is associated with a normal metabolic breathing requirement of the user, a second mode associated with one of: a first physical activity state of the user and a loss of a suit integrity, a third mode associated with one of: a second physical activity state of the user, a cooling of the user, and a loss of a suit function, and a fourth mode associated with a solenoid valve failure open and a prevention of a suit failure.

3. The enclosed system breathing environment pressure regulator of claim 1, wherein the first mode of operation is configured to cause the microcontroller to command the APW at a first flow rate flowing to the enclosed breathing environment, the second mode of operation is configured to cause the microcontroller to command the APW to ensure a second flow rate flowing to the enclosed breathing environment, the third mode of operation is configured to cause the microcontroller to command the APW to ensure a third flow rate flowing to the enclosed breathing environment, the third flow rate greater than the second flow rate, the second flow rate greater than the first flow rate, and the fourth mode of operation limits the flow of oxygen flowing to the enclosed breathing environment to prevent a suit failure.

4. The enclosed system breathing environment pressure regulator of claim 1, wherein the microcontroller is further configured to monitor a suit data from at least one enclosure sensor within with the enclosed breathing environment, the suit data including at least a volume of the enclosed breathing environment, a desired suit pressure, and a current suit pressure and wherein the microcontroller determines the APW based at least in part on the suit data.

5. The enclosed system breathing environment pressure regulator of claim 1, wherein the microcontroller is further configured to periodically perform a built-in-test (BIT) of each of: the initiation command, the at least one manifold sensor, the at least one flow pressure sensor, a circuit continuity associated with the at least one solenoid valve, an operation of the at least one solenoid valve, and the regulated output pressure.

6. The enclosed system breathing environment pressure regulator of claim 1, wherein the enclosed breathing environment further comprises one of: a pressure suit worn by a user, a pressurized compartment associated with a vehicle, and a pressurized compartment associated with a surface structure.

7. The enclosed system breathing environment pressure regulator of claim 1, wherein the pressure manifold comprises at least four solenoid valves wherein three of the at least four solenoid valves are operational valves configured to support a desired environment internal pressure, and wherein the microcontroller is configured to command the pulse interval to a one hundred twenty degree phase between each of the operational valves, and wherein one of the at least four solenoid valves is configured as a pressure relief valve.

8. The enclosed system breathing environment pressure regulator of claim 7, wherein the microcontroller is further configured to monitor an ambient data via at least one ambient sensor and determine the APW based at least in part on the ambient data.

9. The enclosed system breathing environment pressure regulator of claim 1, wherein the pressure manifold further comprises a precision fixed orifice sited between the flow pressure sensor and the enclosed breathing environment, the precision fixed orifice configured to control a flow rate of the variable bolus of oxygen.

10. The enclosed system breathing environment pressure regulator of claim 9, wherein the flow rate of the variable bolus of oxygen is further attenuated by a pressure attenuating plenum sited between the precision fixed orifice and the enclosed breathing environment.

11. The enclosed system breathing environment pressure regulator of claim 1, wherein a desired regulated output pressure is approximately 4.7 pounds per square inch absolute (PSIA).

12. A method for regulating pressure within an enclosed system breathing environment, comprising:

sending an initiation command to a cylinder assembly to initiate a flow of pressure regulated oxygen;

monitoring a manifold data from at least one manifold sensor associated with a pressure manifold which receives the flow of pressure regulated oxygen from the cylinder assembly, the manifold data including a manifold pressure and a manifold temperature;

monitoring a bolus pressure via a flow pressure sensor;

monitoring a regulated output data via a regulated output sensor sited between the flow pressure sensor and an enclosed breathing environment, the regulated output sensor configured to measure a regulated output pressure and a regulated output temperature;

determining an adjusted pulse width (APW) and a pulse interval based on the regulated output data and the manifold data;

applying at least one timed power pulse to at least one solenoid valve to an open position for a duration of the APW at the pulse interval to produce a variable bolus of oxygen supplied to the enclosed breathing environment;

verifying the open position of the at least one solenoid valve based on the bolus pressure;

continuously adjusting the APW based on each of: the regulated output data and the manifold data.

13. The method for regulating pressure within an enclosed system breathing environment of claim 12, further including monitoring a mode of operation associated with the enclosed breathing environment via a mode input, the mode of operation defining a pressurization schedule for the enclosed breathing environment based on at least one of: an anticipated environment internal pressure, an anticipated environment internal temperature, and an anticipated oxygen consumption of a user within the enclosed breathing environment.

14. The method for regulating pressure within an enclosed system breathing environment of claim 12, wherein the mode of operation further comprises at least four modes: a first mode is associated with a normal metabolic breathing requirement of the user, a second mode associated with one of: a physical activity of the user and a loss of a suit integrity, a third mode associated with one of: a cooling of the suit, a loss of a suit function, and the loss of the suit integrity, and a fourth mode associated with one of: a solenoid valve failure open, a loss of manifold supply pressure regulation, and a prevention of a suit failure.

15. The method for regulating pressure within an enclosed system breathing environment of claim 12, further comprising monitoring a suit data from at least one enclosure sensor associated with the enclosed breathing environment, the suit data including at least a volume of the enclosed breathing environment, a desired environment internal pressure, and an environment internal pressure and wherein determining the APW is based at least in part on the suit data.

* * * * *